US010424835B2

(12) United States Patent
Ueda

(10) Patent No.: US 10,424,835 B2
(45) Date of Patent: Sep. 24, 2019

(54) DOOR HANDLE AND ANTENNA UNIT

(71) Applicant: SUMIDA CORPORATION, Tokyo (JP)

(72) Inventor: Hozumi Ueda, Natori (JP)

(73) Assignee: Sumida Corporation (JP)

( * ) Notice: Subject to any disclaimer, the term of this patent is extended or adjusted under 35 U.S.C. 154(b) by 236 days.

(21) Appl. No.: 15/467,185

(22) Filed: Mar. 23, 2017

(65) Prior Publication Data

US 2017/0346173 A1 Nov. 30, 2017

(30) Foreign Application Priority Data

May 30, 2016 (JP) ..... 2016-107858

(51) Int. Cl.
*H01Q 1/32* (2006.01)
*H01Q 1/40* (2006.01)

(52) U.S. Cl.
CPC ..... *H01Q 1/3283* (2013.01); *H01Q 1/3241* (2013.01); *H01Q 1/40* (2013.01)

(58) Field of Classification Search
CPC .. H01Q 1/1271; H01Q 1/3275; H01Q 1/1278; H01Q 1/3291; H01Q 1/28
USPC ..... 343/713, 712, 705, 878, 720
See application file for complete search history.

(56) References Cited

U.S. PATENT DOCUMENTS

2006/0170601 A1* 8/2006 Fang ..... H01Q 1/245 343/702
2006/0197540 A1 9/2006 Negoro et al.
2010/0127635 A1* 5/2010 Yao ..... H01L 33/20 315/291
2012/0133159 A1* 5/2012 Tateishi ..... E05B 81/77 292/336.3

FOREIGN PATENT DOCUMENTS

JP 2006-242882 A 9/2006
JP 2010-209525 A 9/2010

OTHER PUBLICATIONS

Korean Notification of Reason for Refusal issued for Korean Application No. 10-2016-0178887, dated Feb. 28, 2018 (6 pages).

* cited by examiner

*Primary Examiner* — Dameon E Levi
*Assistant Examiner* — Collin Dawkins
(74) *Attorney, Agent, or Firm* — Harness, Dickey & Pierce, P.L.C.

(57) ABSTRACT

A door handle comprising: a housing mounted swingably with respect to a door of a vehicle; an antenna portion accommodated in the housing; an electrostatic-capacity sensor including an electrostatic-capacity detecting electrode, which is accommodated in the housing; and a conductive member which is formed between the electrostatic-capacity detecting electrode and the inner surface of the housing in a state of always being insulated with respect to the electrostatic-capacity detecting electrode.

9 Claims, 8 Drawing Sheets

DOOR HANDLE AND ANTENNA UNIT

CROSS REFERENCES TO RELATED APPLICATIONS

The present invention contains subject matter related to Japanese Patent Application JP2016-107858 filed in the Japanese Patent Office on May 30, 2016, the entire contents of which being incorporated herein by reference.

BACKGROUND OF THE INVENTION

Field of the Invention:

The present invention relates to a door handle and an antenna unit.

Description of the Related Art:

There has been known a key-less entry system in which a control of a door-locking device provided in a vehicle is automatically carried out by communicating with an electronic key which is carried by a user. This kind of key-less entry system is provided with an antenna unit for communicating with the electronic key, which is triggered, for example, by the fact that the user's hand approaches the door handle. This kind of antenna unit is provided with an electrostatic-capacity sensor which includes an electrostatic-capacity detecting electrode for detecting the change of the electrostatic-capacity on an occasion when the user's hand approaches the door handle.

In Japanese unexamined patent publication No. 2006-242882, there is described an electrostatic-capacity sensor which is provided with a connecting conductor-body and a conductive surface conductive with the connecting conductor-body, for the electrostatic-capacity sensor including a sensor main body and an electrostatic-capacity detecting electrode (detecting electrode in JP 2006-242882) provided in the sensor main body. This electrostatic-capacity sensor is provided for a flap-type handle. It is conceivable that the connecting conductor-body is conductive with the electrostatic-capacity detecting electrode.

SUMMARY OF THE INVENTION

Meanwhile, in recent years, the design of the door handle tends to diversify. For this reason, it is assumed that caused by the shape of the door handle, the detectable distance-range, in which the electrostatic-capacity detecting electrode and the user's hand are considered to be adequately close, becomes extremely restricted. On the other hand, when it happens that the sensitivity of the electrostatic-capacity sensor is set to be so high such that it is possible to reliably detect the user's hand even under such a condition, there will be a possibility that malfunction of the key-less entry system would occur frequently whenever foreign substances such as dusts, raindrops and the like approach the electrostatic-capacity detecting electrode.

In addition, for the key-less entry system, it is required to shorten the response time from the time when the user's hand approaches the door handle to the time when the door lock is released as soon as possible.

For those reasons, there is requested such an ingenious-idea in which even while setting the sensitivity of the electrostatic-capacity sensor low, the reaction time until detecting the fact that the user's hand approached the door handle can be shorten.

According to the study of the present inventor, the technology of JP 2006-242882 does not always satisfy the abovementioned requirements adequately.

The present invention was invented in view of the abovementioned problem and provides a door handle and an antenna unit having structures in which even while setting the sensitivity of the electrostatic-capacity sensor to be low, it is possible to shorten the reaction time until detecting the fact that the user's hand approached the door handle.

According to the present invention, there is provided a door handle including: a housing mounted swingably with respect to a door of a vehicle; an antenna portion accommodated in the housing; an electrostatic-capacity sensor including an electrostatic-capacity detecting electrode, which is accommodated in the housing; and a conductive member which is formed between the electrostatic-capacity detecting electrode and the inner surface of the housing in a state of always being insulated with respect to the electrostatic-capacity detecting electrode.

In addition, according to the present invention, there is provided an antenna unit including: an antenna; an electrostatic-capacity sensor including an electrostatic-capacity detecting electrode; an insulating coating member which coats the antenna and the electrostatic-capacity detecting electrode; and a conductive member fixed on the outer surface of the coating member.

According to the present invention, even while setting the sensitivity of the electrostatic-capacity sensor to be low, it becomes possible to shorten the reaction time until detecting the fact that the user's hand approached the door handle.

BRIEF DESCRIPTION OF THE DRAWINGS

FIGS. 7A and 7B are schematic views of an antenna unit relating to a third embodiment, wherein FIG. 7A shows a side view and FIG. 7B shows a plan view;

DESCRIPTION OF THE PREFERRED EMBODIMENTS

Figure 1:
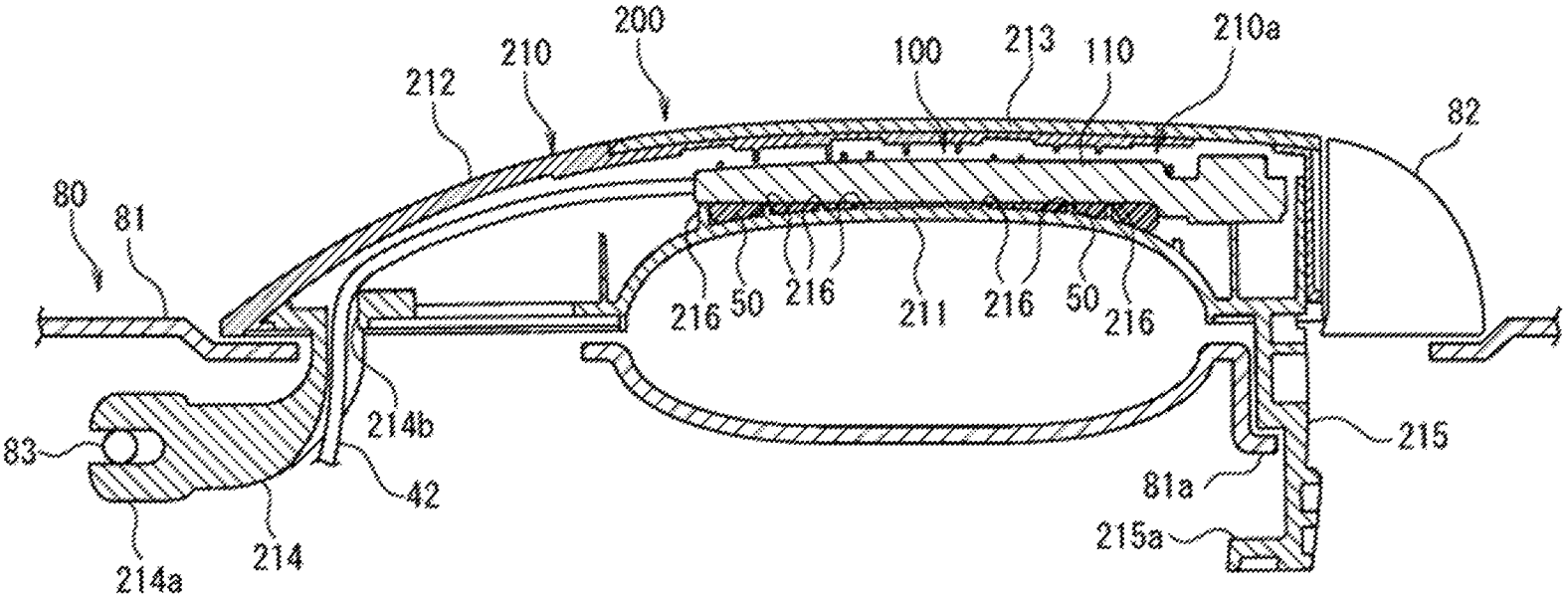
FIG. 1 is a schematic view showing a door handle relating to a first embodiment.

Hereinafter, embodiments of the present invention will be explained by using the drawings. It should be noted in all of the drawings that the same reference numerals are applied to similar constituent elements and the explanations thereof will be arbitrarily omitted.

[First Embodiment]

FIG. 1 is a schematic view showing a door handle 200 relating to a first embodiment.

Figure 2:
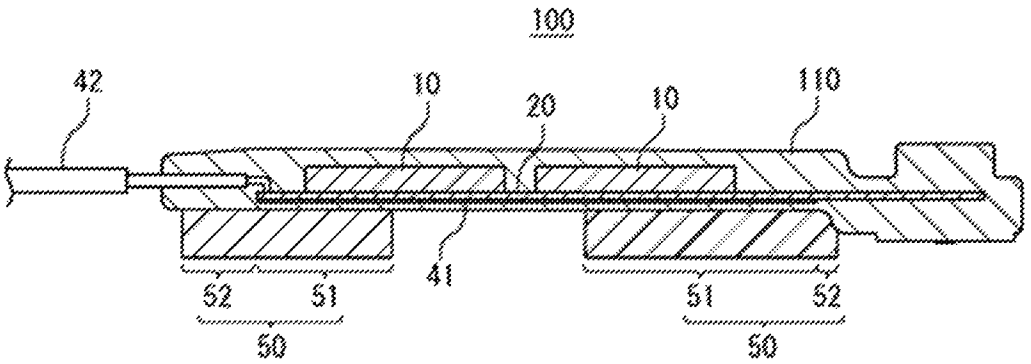
FIG. 2 is a schematic view of an antenna unit relating to the first embodiment.

FIG. 2 is a schematic flat cross-sectional view showing an antenna unit 100 relating to the first embodiment.

The door handle 200 relating to this embodiment is a handle used by being incorporated with a door 80 of a vehicle that employs a key-less entry system which carries out the control of the lock and the unlock of the door 80 automatically by communicating with an electronic key (not shown) which is carried by a user.

In addition, the antenna unit 100 relating to this embodiment is to be used by being incorporated with the door handle 200 of the vehicle that employs the key-less entry system.

As shown in FIG. 1, the door handle 200 relating to this embodiment includes: a housing 210 mounted swingably with respect to a door 80 of a vehicle; an antenna portion accommodated in the housing 210; an electrostatic-capacity sensor including an electrostatic-capacity detecting electrode (see FIG. 2) which is accommodated in the housing 210; and a conductive member 50 which is formed between the electrostatic-capacity detecting electrode 41 and the inner surface of the housing 210 in a state of always being insulated with respect to the electrostatic-capacity detecting electrode 41.

The antenna portion has a constitution excluding the electrostatic-capacity sensor and the conductive member 50 from the antenna unit 100 which will be mentioned later.

In addition, the electrostatic-capacity sensor is constituted by the electrostatic-capacity detecting electrode 41 and a control circuit 40 (see FIG. 3) which will be mentioned later. At least the electrostatic-capacity detecting electrode 41 within the constitution of the electrostatic-capacity sensor is accommodated in the housing 210. It should be noted, in case of this embodiment, that also the control circuit 40 is accommodated in the housing 210 and therefore, the whole electrostatic-capacity sensor is accommodated in the housing 210.

Hereinafter, there will be a detailed explanation thereof.

In FIG. 1, there is shown an outer-surface panel 81 of a door 80 of a vehicle partially and concurrently, there is shown a state in which a door handle 200 is mounted on the aforesaid outer-surface panel 81. In FIG. 1, there is shown a schematic flat cross-sectional structure with regard to the outer-surface panel 81 and the door handle 200. At a position adjacent to one end side of the door handle 200, a cover portion 82 is mounted on the outer-surface panel 81. This cover portion 82 is shown as the planar view thereof.

In FIG. 1, the area on the upper side compared with the outer-surface panel 81 shows an area on the external-portion side of the vehicle and the area on the lower side compared with the outer-surface panel 81 shows an area on the inner-portion side of the vehicle. In FIG. 1, the left side shows the front side of the vehicle and the right side shows the rear side of the vehicle.

In case of this embodiment, the door handle 200 is designed as a lever-type handle in which one end portion thereof in the longitudinal direction of the housing 210 is pivotally supported with respect to the door 80. The swing shaft of the door handle 200 is extended substantially toward the up and down direction. The door handle 200 is extended substantially along the front-back direction of the vehicle.

In recent years, it has been tried for the door handle 200 that the center portion in the longitudinal direction of the aforesaid door handle 200 is formed in a curved shape so as to bulge-out in an arc shape toward the external-portion side of the vehicle and also the door handle 200 relating to this embodiment is formed in such a curved shape. More specifically, in a state in which the door handle 200 is mounted on the door 80, the housing 210 of the door handle 200 is formed such that the center portion in the longitudinal direction of the housing 210 is formed in a curved shape so as to bulge-out in an arc shape toward the external-portion side of the vehicle. Therefore, the housing 210 is curved in an arc shape (arch shape) in a plan view thereof.

It should be noted that for the outer-surface panel 81, a portion thereof which is facing the door handle 200 is, for example, recessed in a concave-surface shape toward the inside of the vehicle and there is employed a configuration in which it becomes easy for a hand to insert between the door handle 200 and the outer-surface panel 81.

In a state in which a door-locking device 60 (FIG. 3), which will be mentioned later, unlocks the door 80, there is employed a configuration wherein by an operation of a user who grasps the door handle 200 by his hand and pulls the door handle 200 toward the external-portion side (upper side in FIG. 1) of the vehicle, the door handle 200 will swing with respect to the door 80 and concurrently, it becomes possible to open the door 80.

For the housing 210, there is employed a configuration in which its one end portion (for example, front end portion) is pivotally supported by a shaft portion 83 in the inside of the door 80 and in which the housing 210 is swingable with respect to the door 80.

The housing 210 is constituted, for example, by including: an inside member 211 which is formed for the aforesaid housing 210 on the near side of the door 80, an outside member 212 formed on the side far from the door 80 compared with the inside member 211, and an outside cover 213 which is mounted on the outer-surface side of the outside member 212.

By employing a configuration in which the inside member 211 and the outside member 212 are mutually assembled and also, in which the outside cover 213 is mounted on the outer-surface side of the outside member 212, the housing 210 is constituted.

In the inside of the housing 210, there is formed an accommodating space **210*a* which accommodates the antenna unit 100**.

It should be noted that also the accommodating space **210*a* is formed such that the center portion in the longitudinal direction of the housing 210** is formed in a curved shape so as to bulge-out in an arc shape toward the external-portion side of the vehicle.

In more detail, the inner surface of the inside member 211 is formed in a curved shape so as to bulge-out in an arc shape toward the external-portion side of the vehicle at the center portion in the longitudinal direction of the housing 210. In addition, the inner surface of the outside member 212 is formed in a curved shape by being recessed in an arc shape toward the external-portion side of the vehicle at the center portion in the longitudinal direction of the housing 210.

As shown in FIG. 1, a straight-shaped antenna unit 100 is formed in the accommodating space **210*a* and also, the longitudinal direction of the aforesaid antenna unit 100 is formed along the longitudinal direction of the housing 210. The gap between the inner surface of the inside member 211 and the antenna unit 100 is formed to be narrow at the center portion in the longitudinal direction of the antenna unit 100 and is formed to be gradually wider as going away from the center portion in the longitudinal direction of the antenna unit 100**.

A plurality of ribs 216 are formed on the inner surface of the housing 210. Thus, a sufficient strength of the housing 210 can be secured.

For those ribs 216, there are included a plurality of ribs 216 which support the antenna unit 100. The antenna unit 100 formed in the inside of the accommodating space **210*a* is restricted for the movement thereof in the inside of the aforesaid accommodating space 210***a* by a mechanism of being supported by the plurality of ribs 216.

Although there is no limitation in particular for the material of the housing 210, the housing 210 is constituted, for example, by an insulating resin.

At the both end portions of the inside member 211, there are respectively formed bent portions 214, 215 which are formed in shapes of being bent toward the inside of the vehicle (in other words, toward the inner-portion side of the door 80). The respective bent portions 214, 215 are inserted into the inside of the door 80 respectively.

At the distal portion of the front-side bent portion 214, there is formed a shaft-supported portion 214*a*. The shaft-supported portion 214*a* is pivotally supported by the shaft portion 83 in the inside of the door 80.

At the distal portion of the rear-side bent portion 215, there is formed an engagement portion 215*a*. For the outer-surface panel 81 of the door 80, there is formed, at a portion corresponding to the engagement portion 215*a*, a stopper portion 81*a* which the engagement portion 215*a* engages when the door handle 200 is pulled and swung. There is employed a configuration in which when opening the door 80 by pulling the door handle 200, the swing of the door handle 200 with respect to the door 80 is to be restricted by a mechanism in which the engagement portion 215*a* engages the stopper portion 81*a*.

At the front-side bent portion 214, there is formed a wiring passage 214*b* which communicates the inside space and the outside space of the outer-surface panel 81 mutually. Through the wiring passage 214*b*, a wiring 42 connected to the antenna unit 100 is routed from the space on the outside (upper side in FIG. 1) of the outer-surface panel 81 to the space on the inside (lower side in FIG. 1) thereof.

The conductive member 50 is constituted, for example, by a flexible material. Then, the conductive member 50 is formed in a compressed state between the electrostatic-capacity detecting electrode 41 and the inner surface of the housing 210. Here, the description of "the conductive member 50 is flexible" in the present specification means that the conductive member 50 has a large deformation-volume with respect to the load as much as or more than that of an elastomer having a solid structure. Thus, it becomes in a state in which the conductive member 50 is deformable easily along the inner-surface shape of the housing 210 and concurrently, is deformable easily along the outer-surface shape of a coating member 110 which will be mentioned later. However, it is preferable for the conductive member 50 to be constituted by a material such as a conductive sponge or the like which has a larger deformation-volume with respect to the load than that of an elastomer having a solid structure.

It is preferable for the conductive member 50 to be formed by a conductive sponge. It is preferable for this conductive sponge to be constituted by including a carbon-based conductive material in view of the water resistant thereof. Other than the conductive sponge, it is also possible for the conductive member 50 to use a material which is easily deformed elastically such as a conductive silicone rubber or the like.

As described above, a plurality of ribs 216 are formed on the inner surface of the housing 210. Then, it is preferable that at least a portion of the conductive member 50 enters into spaces formed between two adjacent ones of the plurality of ribs 216 which are facing each other.

As shown in FIG. 2, the antenna unit 100 relating to this embodiment is provided with the antenna 10, the electrostatic-capacity sensor including the electrostatic-capacity detecting electrode 41, the insulating coating member 110 which coats the antenna 10 and the electrostatic-capacity detecting electrode 41, and the conductive member 50 which is fixed on the outer surface of the coating member 110.

Therefore, the conductive member 50 is always insulated with respect to the electrostatic-capacity detecting electrode 41. In addition, when the antenna unit 100 is accommodated in the inside of the housing 210 of the door handle 200 (in a state in which the antenna unit 100 is formed in the inside of the accommodating space 210*a*). And the conductive member 50 is formed between the electrostatic-capacity detecting electrode 41 and the inner surface of the housing 210.

There is no limitation in particular for the method of fixing the conductive member 50 on the outer surface of the coating member 110. For example, it is possible to fix the conductive member 50 on the outer surface of the coating member 110 by using a double-sided adhesive tape or an adhesive agent. It is allowed for the coating member 110 to be formed by a mold resin and it is also allowed to employ a sealed case-shaped member composed of a molding resin.

The antenna unit 100 is formed in a long shape in one direction. The longitudinal direction of the antenna unit 100 is made to conform to the right-left direction in FIG. 2. Then, the longitudinal direction of the antenna unit 100 is formed along the longitudinal direction of the housing 210.

In case of this embodiment, two conductive members 50 are formed by being mutually separated in the longitudinal direction of the antenna unit 100. More specifically, the conductive members 50 are formed at respective positions corresponding to mutually separated plurality of places in the longitudinal direction of the antenna unit 100.

In addition, the conductive members 50 are formed at respective positions corresponding to mutually separated plurality of places in the longitudinal direction of the antenna portion (portion excluding the electrostatic-capacity sensor and the conductive member 50 from the antenna unit 100).

Here, it is allowed to form the individual conductive members 50 integrally as the whole thereof and it is also allowed to constitute them by arranging a plurality of minute conductive members mutually-adjacently.

The antenna 10 is constituted by including a core (not shown) and a coil 12 which is wound around the core. For the material of the core, there is used, for example, a Ni—Zn based ferrite, a Mn—Zn based ferrite, a metal based magnetic material or an amorphous magnetic material. The core is formed, for example, in a long shape in one direction and the coil is wound around the longitudinal axis of the coil.

There is no limitation in particular for the number of antennas 10 which are provided in the antenna unit 100. In FIG. 2, there is shown an example in which the antenna unit 100 is provided with two antennas 10, but it is allowed that the number of antennas 10 which the antenna unit 100 is provided with may be one or may be three or more.

The antenna unit 100 is provided with a substrate 20. On the substrate 20, there are installed various kinds of electrical components. For the electrical components installed on the substrate 20, there are included the antenna 10 and the electrostatic-capacity detecting electrode 41. The substrate 20 is coated (sealed) by the coating member 110 together with various kinds of electrical components (including the antenna 10 and the electrostatic-capacity detecting electrode 41) which are installed on the substrate 20.

Here, the electrostatic-capacity detecting electrode 41 and the conductive member 50 are formed on one surface side (lower-surface side in FIG. 2) of the substrate 20. In more detail, the electrostatic-capacity detecting electrode 41 is formed on one surface (surface on the lower side in FIG. 2) of the substrate 20. In addition, the conductive member 50 is fixed on the lower-side surface in FIG. 2 within the outer surfaces of the coating member 110.

In this manner, the antenna unit 100 is installed with the antenna 10 and the electrostatic-capacity detecting electrode 41 and concurrently is provided with the substrate 20 which is coated by the coating member 110. And the electrostatic-capacity detecting electrode 41 and the conductive member 50 are formed on one surface side of the substrate 20 thereof. In other words, the electrostatic-capacity detecting electrode 41 and the conductive member 50 are formed on the same side with respect to the substrate 20.

It should be noted that the antenna 10 is installed on the other surface (upper-side surface in FIG. 2) of the substrate 20. In addition, it is also allowed for the antenna 10 to be mounted on the bottom surface of the case-shaped coating member 110.

The electrostatic-capacity detecting electrode 41 is formed in a flat-sheet shape or in a flat-plate shape. The electrostatic-capacity detecting electrode 41 is constituted, for example, by a press-molded product of a conductive metal plate. There is no limitation in particular for the material of the electrostatic-capacity detecting electrode 41 and it is preferable to employ, for example, a copper alloy such as a beryllium copper, a phosphor bronze (Cu—Sn—P alloy) or the like.

There is no limitation in particular for the fixing method of the electrostatic-capacity detecting electrode 41 to the substrate 20 and it is possible to employ an arbitrary method such as, for example, adhesion, fitting, press-fitting, locking or the like.

One surface of the coating member 110 is formed in the vicinity of the one surface of the substrate 20. Therefore, the conductive member 50 which is provided on the one surface of the coating member 110 is formed in the vicinity of the electrostatic-capacity detecting electrode 41 which is provided on the one surface of the substrate 20.

Here, when seen toward the surface-perpendicular direction (up-down direction in FIG. 2) with respect to the electrostatic-capacity detecting electrode 41, the conductive member 50 includes an overlapping portion 51 which overlaps with the electrostatic-capacity detecting electrode 41 and an extension-portion 52 which does not overlap with the electrostatic-capacity detecting electrode 41.

Figure 3:
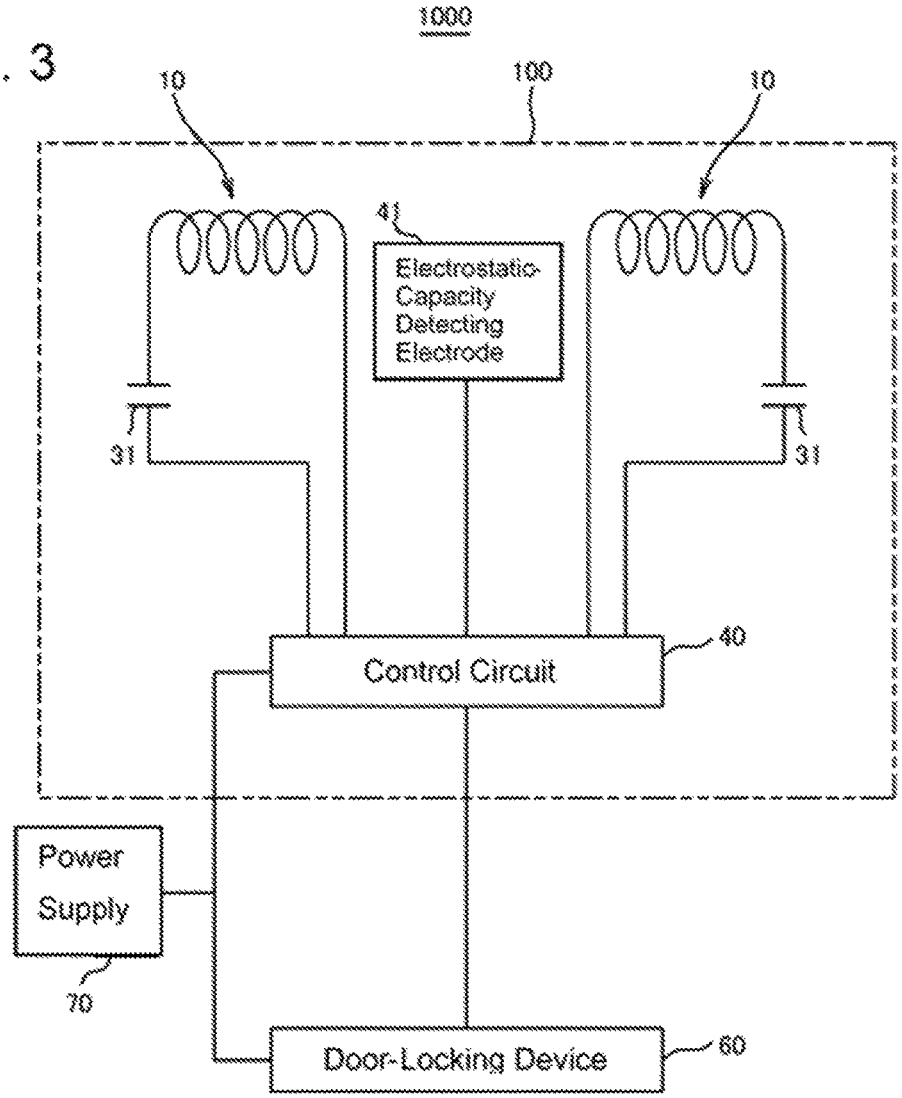
FIG. 3 is a schematic diagram of a key-less entry system which includes the antenna unit relating to the first embodiment.

FIG. 3 is a schematic diagram of a key-less entry system 1000 including the antenna unit 100 relating to this embodiment in which a circuit configuration and a block configuration of the key-less entry system 1000 are shown by being mixed-up.

As shown in FIG. 3, the key-less entry system 1000 includes: a control circuit 40 which carries out an operation control of the key-less entry system 1000, a door-locking device 60 which switches the state of the door 80 to a locking state or to an unlocking state, and a power supply 70 which can supply an electric power to each portion of the key-less entry system 1000. The power supply 70 is, for example, the vehicle-battery.

The control circuit 40 includes a detection circuit which detects the electrostatic-capacity change at the electrostatic-capacity detecting electrode 41. This detection circuit is electrically connected with the electrostatic-capacity detecting electrode 41.

More specifically, the antenna unit 100 is provided with an electrostatic-capacity sensor which is constituted by the electrostatic-capacity detecting electrode 41 and the detection circuit.

In addition, the control circuit 40 includes an authentication circuit which carries out an authentication-processing of the electronic key which is carried by the user.

In addition, each antenna 10 is electrically connected with respect to the control circuit 40 and there is employed a configuration in which the operation of the each antenna 10 is to be controlled by the control circuit 40.

The control circuit 40 is constituted, for example, by one or a plurality of electrical components installed on the substrate 20.

Individual capacitors 31 are connected to the plurality of antennas 10 respectively. Further the antennas 10 constitute LC resonant circuits respectively. For example, capacitors 31 are connected in series to the antennas 10 respectively.

The control circuit 40 is constituted so as to recognize the fact that the user's hand contacts or approaches a portion in the vicinity of the electrostatic-capacity detecting electrode 41 in the door handle 200 by detecting the change of the electrostatic-capacity at the electrostatic-capacity detecting electrode 41 and so as to transmit from the plurality of antennas 10 a request signal for an authentication of the electronic key (not shown) which is carried by a user.

Further, the control circuit 40 is provided with a receiving antenna which is not shown and monitors whether or not an ID signal which is transmitted from the electronic key is received by that receiving antenna during a predetermined period after the transmission of the request signal is started from the antenna 10.

In a case in which an ID signal corresponding to the ID code stored by the control circuit 40 beforehand is received by the receiving antenna, the control circuit 40 controls the door-locking device 60 and unlocks the locking of the door 80 (an unlocking state is made).

On the other hand, in a case in which an ID signal corresponding to the ID code stored by the control circuit 40 beforehand is not received by the receiving antenna, the control circuit 40 keeps the locking of the door 80 in a locking state.

Therefore, when the user who carries an electronic key touches a portion in the vicinity of the electrostatic-capacity detecting electrode 41 in the door handle 200 in order to open the door 80, that fact is detected by the electrostatic-capacity sensor and a request signal is transmitted from the antenna unit 100 toward the electronic key. Then, which it receives the request signal, the electronic key transmits its own ID signal to the control circuit 40. And when it receives that ID signal, the control circuit 40 judges whether or not the ID code included in that received ID signal coincides with the ID code which was stored beforehand. In a case in which both the ID codes coincide with each other (in a case in which authentication was obtained), the control circuit 40 drives an actuator of the door-locking device 60, sets the lock of the door 80 in an unlocking state and enables the opening of the door 80.

On the other hand, in a case in which both the ID codes do not coincide with each other (in a case in which authentication was not obtained), the control circuit 40 keeps the lock of the door 80 in a locking state.

Figure 4:
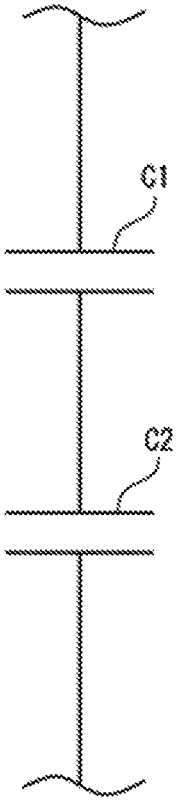
FIG. 4 is an explanatory chart of the door handle relating to the first embodiment.

FIG. 4 is an explanatory chart of the door handle 200 relating to the first embodiment. More specifically, FIG. 4 is a chart showing an equivalent circuit including a capacitor C1 formed between the conductive member 50 and the user's hand and a capacitor C2 formed between the electrostatic-capacity detecting electrode 41 and the conductive member 50 in the door handle 200 shown in FIG. 1.

When supposing that the capacity of the capacitor C1 is "A" and the capacity of the capacitor C2 is "B", the combined capacity of the capacitor C1 and the capacitor C2 becomes ("A×B")/("A+B"). Here, the conductive member 50 is close to the electrostatic-capacity detecting electrode 41 and therefore, it is possible to increase the capacity "B". Thus, the change-amount of the combined capacity when the capacity "A" is changed by the fact that the user's hand approaches the door handle 200 becomes large. Therefore, even if the sensitivity of the electrostatic-capacity sensor is set to be low, it is possible to speed-up the response of the electrostatic-capacity sensor.

More specifically, even while the sensitivity of the electrostatic-capacity sensor is set to be low, it becomes possible to shorten the reaction time until detecting the fact that the user's hand approached the door handle 200.

On the other hand, it is conceivable that the technology of JP 2006-242882 employs a configuration in which the connecting conductor-body and the electrostatic-capacity detecting electrode are conductive and therefore, the used capacity becomes a single capacity of the capacitor which is formed between the conductive surface and the hand. For this reason, it is conceivable that the reaction speed of the electrostatic-capacity sensor becomes slow therein compared with that of this embodiment.

According to the first embodiment as described above, the door handle 200 is provided with the conductive member 50 which is formed between the electrostatic-capacity detecting electrode 41 and the inner surface of the housing 210 in a state of always being insulated with respect to the electrostatic-capacity detecting electrode 41.

Thus, it is possible to fill-in the gap between the electrostatic-capacity detecting electrode 41 and the inner surface of the housing 210 by the conductive member 50 and therefore, it is possible to adequately enlarge the detectable distance-range in which it is possible to realize an excellent detection by the electrostatic-capacity sensor.

Furthermore, as explained by using FIG. 4, it is possible to increase the change-amount of the electrostatic-capacity caused by the approach of the hand to the electrostatic-capacity detecting electrode 41 and therefore, it becomes possible to improve the detection speed for the change of the electrostatic-capacity. Thus, even if the sensitivity of the electrostatic-capacity sensor is low, it is possible to detect the fact that the user's hand approaches the door handle 200 more reliably and concurrently, it becomes possible to shorten the reaction time.

In addition, depending on the configuration that the conductive member 50 which is constituted by a flexible material is formed in a compressed state between the electrostatic-capacity detecting electrode 41 and the inner surface of the housing 210, the conductive member 50 is deformed along the inner surface of the housing 210 and is closely in contact with the inner surface excellently. Therefore, it is possible to shorten the gap adequately between the conductive member 50 and the inner surface of the housing 210.

As described above, in recent years, the design of the door handle 200 tends to diversify, but according to this embodiment, it is possible to fill-in the gap between the electrostatic-capacity detecting electrode 41 and the inner surface of the housing 210 by the conductive member 50 which is as flexible as easily deformable. Therefore, in respective cases in which the antenna units 100 having common shapes are formed in the inside of the door handles 200 having various kinds of designs, it becomes possible to realize excellent detections by the electrostatic-capacity sensors. Therefore, it is possible to commonly use the antenna unit 100 for the door handles 200 having various kinds of designs.

In addition, it is possible to configure the conductive member 50 so as to serve a function as the cushion material and therefore, for example, when the door handle 200 is dropped accidentally when mounting the door handle 200, it is possible to protect the device such as the antenna 10 or the like which the door handle 200 is provided with. In addition, in a case in which a stress is applied to the door handle 200, it is also possible to soften the stress applied to the device such as the antenna 10 or the like which the door handle 200 is provided with.

In addition, at least a portion of the conductive member 50 enters into at least a space formed between two adjacent ones of the plurality of ribs 216 which are facing to each other. And each of the ribs 216 is formed on the inner surface of the housing 210. Therefore, it is possible to shorten the gap more adequately between the conductive member 50 and the inner surface of the housing 210.

In addition, for the housing 210, the center portion in the longitudinal direction of aforesaid housing 210 is formed in a curved shape so as to bulge-out in an arc shape toward the external-portion side of the vehicle, the longitudinal direction of the antenna portion is formed along the longitudinal direction of the housing 210, and the conductive members 50 are formed at respective positions corresponding to mutually separated plurality of places in the longitudinal direction of the antenna portion. More specifically, the conductive members 50 are formed at respective positions corresponding to mutually separated plurality of places in the longitudinal direction of the antenna unit 100. Therefore, it is possible to arrange the conductive member 50 at a portion in which the gap between the inner surface of the housing 210 and the antenna portion tends to become large (at a portion in which the gap between the inner surface of the housing 210 and the antenna unit 100 tends to become large).

Thus, it is possible to enlarge the distance-range more preferably in which it is possible to realize an excellent detection by the electrostatic-capacity sensor.

In addition, when seen toward the surface-perpendicular direction with respect to the electrostatic-capacity detecting electrode 41, the conductive member 50 includes an overlapping portion 51 which overlaps with the electrostatic-capacity detecting electrode 41 and an extension-portion 52 which does not overlap with the electrostatic-capacity detecting electrode 41. Therefore, not only it is possible to merely fill-in the gap between the electrostatic-capacity detecting electrode 41 and the inner surface of the housing 210 by the overlapping portion 51, but also it becomes possible caused by the existence of the extension-portion 52 to further enlarge the distance-range in which it is possible to realize an excellent detection by the electrostatic-capacity sensor.

[Second Embodiment]

Figure 5:
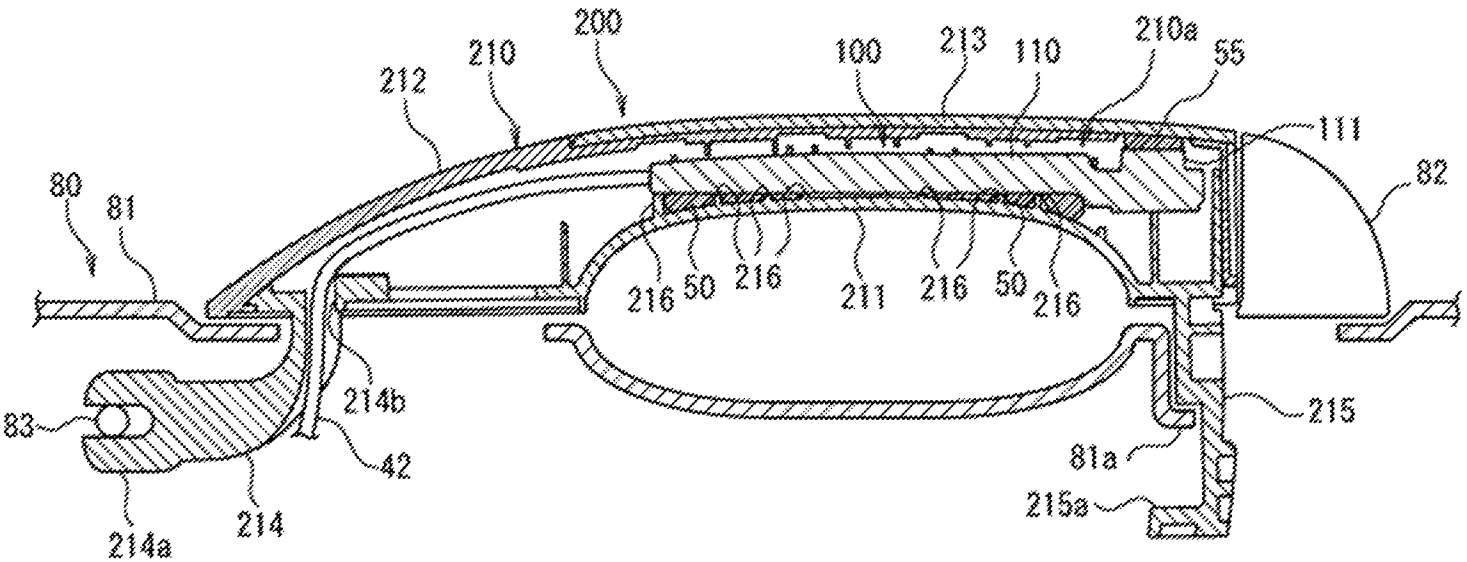
FIG. 5 is a schematic view showing a door handle relating to a second embodiment.
Figure 6:
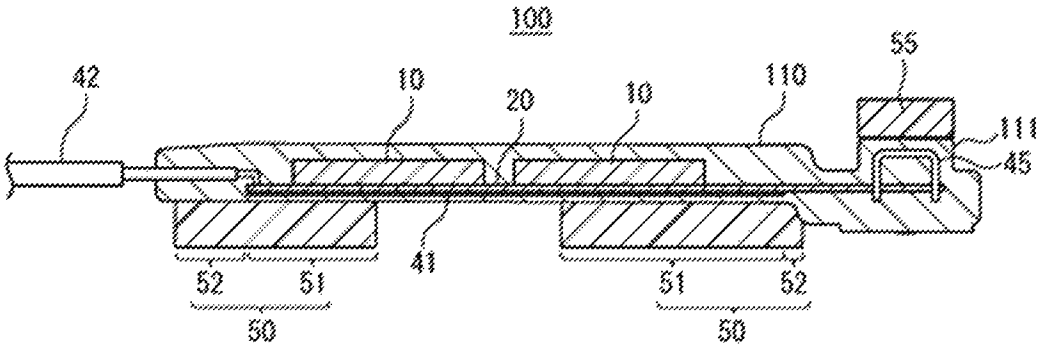
FIG. 6 is a schematic view of an antenna unit relating to the second embodiment.

FIG. 5 is a schematic view showing a door handle 200 relating to a second embodiment. FIG. 6 is a schematic view of an antenna unit 100 relating to the second embodiment.

The door handle 200 and the antenna unit 100 relating to this embodiment are different from the door handle 200 and the antenna unit 100 relating to the abovementioned first embodiment in that there are included a second conductive member 55 and a second electrostatic-capacity detecting electrode 45 therein, in which other constituents thereof are constituted similarly as the door handle 200 and the antenna unit 100 relating to the abovementioned first embodiment.

As shown in FIG. 6, also in case of this embodiment, there are formed the electrostatic-capacity detecting electrode 41 and the conductive member 50 on the one surface side of the substrate 20.

In case of this embodiment, there is provided the second electrostatic-capacity detecting electrode 45 on the other surface side of the substrate 20. Here, it is allowed for the second electrostatic-capacity detecting electrode 45 to be provided by penetrating the substrate 20. However, the second electrostatic-capacity detecting electrode 45 is formed such that the protruding-amount toward the other surface side of the substrate 20 is larger than the protruding-amount toward the one surface side thereof.

Then, on the outer surface of the coating member 110, there is fixed the second conductive member 55 at the position corresponding to the second electrostatic-capacity detecting electrode 45. The second conductive member 55 is a member which is similar to the conductive member 50. More specifically, the second conductive member 55 is formed, for example, by a conductive sponge.

In more detail, for the coating member 110, the portion coating the second electrostatic-capacity detecting electrode 45 is formed, for example, as a protruding portion 111 which protrudes toward the other surface side of the substrate 20 and the second conductive member 55 is provided on that protruding portion 111.

It should be noted that for the antenna unit 100, there are formed the second electrostatic-capacity detecting electrode 45 and the second conductive member 55 at the portion on the side far from the shaft-supported portion 214*a* (at the portion on the side near the engagement portion 215*a*).

In case of this embodiment, the antenna unit 100 is provided with a second electrostatic-capacity sensor constituted by the second electrostatic-capacity detecting electrode 45 and the control circuit 40.

More specifically, the control circuit 40 includes a second detection circuit which detects the change of the electrostatic-capacity for the second electrostatic-capacity detecting electrode 45. To this second detection circuit, there is electrically connected the second electrostatic-capacity detecting electrode 45.

The control circuit 40 is constituted so as to recognize the fact that the user's hand contacts or approaches a portion in the vicinity of the second electrostatic-capacity detecting electrode 45 in the door handle 200 by detecting the change of the electrostatic-capacity at the second electrostatic-capacity detecting electrode 45 and so as to transmit from the plurality of antennas 10 a request signal for an authentication of the electronic key (not shown) which is carried by a user.

Further, the control circuit 40 is provided with a receiving antenna which is not shown and monitors whether or not an ID signal which is transmitted from the electronic key is received by that receiving antenna during a predetermined period after the transmission of the request signal is started from the antenna 10.

In this case, in a case in which an ID signal corresponding to the ID code stored by the control circuit 40 beforehand is received by the receiving antenna, the control circuit 40 controls the door-locking device 60 and reverses the locking state of the door 80. More specifically, in case of an unlocking state, the door will be locked and in case of a locking state, the door will be unlocked.

On the other hand, in a case in which an ID signal corresponding to the ID code stored by the control circuit 40 beforehand is not received by the receiving antenna, the control circuit 40 keeps the lock state of the door 80.

Therefore, when the user who carries an electronic key touches a portion in the vicinity of the second electrostatic-capacity detecting electrode 45 in the door handle 200 in order to close the door 80, that fact is detected by the second electrostatic-capacity sensor and a request signal is transmitted from the antenna unit 100 toward the electronic key. Then, the electronic key which receives the request signal transmits its own ID signal with respect to the control circuit and the control circuit 40 which receives that ID signal judges whether or not the ID code included in that received ID signal coincides with the ID code which was stored beforehand. In a case in which both the ID codes coincide with each other (in a case in which authentication was obtained), the control circuit 40 drives an actuator of the door-locking device 60 and reverses the locking state of the door 80.

On the other hand, in a case in which both the ID codes do not coincide with each other (in a case in which authentication was not obtained), the control circuit 40 keeps the locking state of the door 80.

In case of this embodiment, the second conductive member 55 is formed in a compressed state between the second electrostatic-capacity detecting electrode 45 and the inner surface of the housing 210. Therefore, it is possible to fill-in the gap between the second electrostatic-capacity detecting electrode 45 and the inner surface of the housing 210 by the second conductive member 55 and therefore, it is possible to realize an excellent detection by the second electrostatic-capacity sensor.

Furthermore, it is possible to increase the change-amount of the electrostatic-capacity caused by the approach of the hand with respect to the second electrostatic-capacity detecting electrode 45 and therefore, it becomes possible to improve the detection speed for the change of the electrostatic-capacity. Thus, even if the sensitivity of the second electrostatic-capacity sensor is low, it is possible to detect the fact that the user's hand approaches the door handle 200 more reliably and concurrently, it becomes possible to shorten the reaction time.

[Third Embodiment]

Figure 7A:
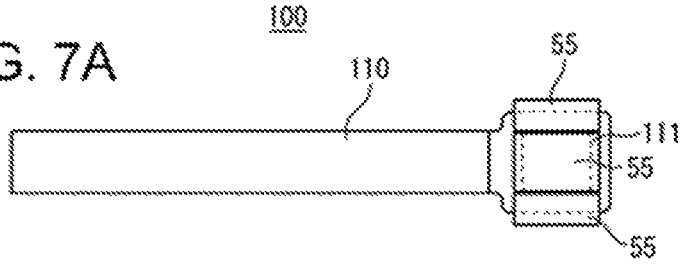
Figure 7B:
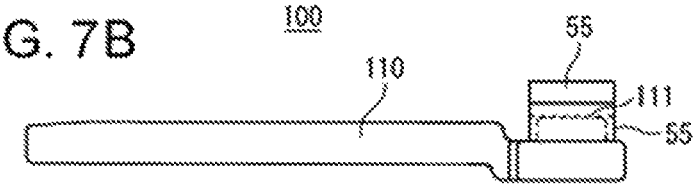

FIGS. 7A and 7B are schematic views of an antenna unit 100 relating to a third embodiment, in which FIG. 7A is a side view thereof and FIG. 7B is a plan view thereof.

The antenna unit 100 relating to this embodiment is different from the antenna unit 100 relating to the abovementioned second embodiment in a configuration which will be explained hereinafter and for other configurations, there are employed similar constitutions as the antenna unit 100 relating to the second embodiment.

In case of this embodiment, a plurality of second conductive members 55 exist at the periphery of the protruding portion 111 (in other words, periphery of the second electrostatic-capacity detecting electrode 45 (see FIG. 6)) and the second conductive members 55 are formed at a plurality of places around the axis of the antenna unit 100 respectively. In more detail, the second conductive members 55 are provided at three places on the front side, on the upper side and on the lower side of the protruding portion 111 respectively.

Thus, at the plurality of places around the shaft of the antenna unit 100, it is possible to fill-in the gap between the second electrostatic-capacity detecting electrode 45 and the inner surface of the housing 210 by the second conductive members 55. For this reason, it is possible to realize more excellent detection by the second electrostatic-capacity sensor.

[Fourth Embodiment]

Figure 8A:
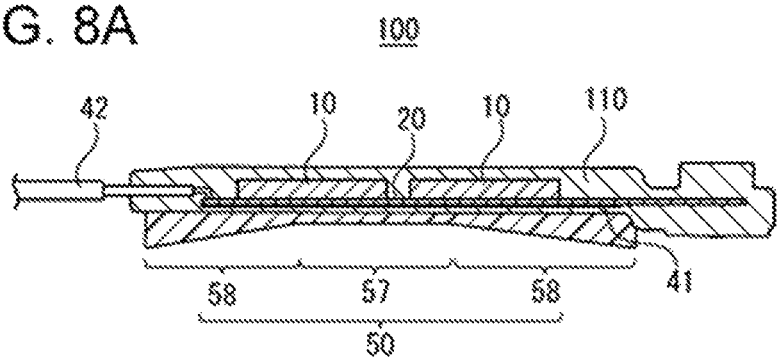
FIG. 8A is a schematic view of an antenna unit relating to a fourth embodiment.

FIG. 8A is a schematic view of an antenna unit 100 relating to a fourth embodiment. In case of this embodiment, the conductive member 50 is constituted by including a flat portion 57 whose thickness is constant (uniform) and inclined portions 58 whose thicknesses are changed depending on the positions thereof.

In more detail, the conductive member 50 includes two inclined portions 58 and a flat portion 57 which is formed between those inclined portions 58, in which along the longitudinal direction of the antenna unit 100, one inclined portion 58, the flat portion 57 and the other inclined portion 58 are formed side by side in that order.

In addition, each of the inclined portions 58 is formed in a shape, of which the thickness thereof is increased gradually when it is going away from the flat portion 57. In addition, the portion with the smallest thickness in the inclined portion 58 is set with a thickness that is identically as that of the flat portion 57.

In other words, in the longitudinal direction of the antenna unit 100 (in the longitudinal direction of the antenna portion), the thicknesses at the both end portions of the conductive member 50 are formed to be larger than that of the center portion of the conductive member 50.

The center portion in the longitudinal direction of the housing 210 is formed in a curved shape which bulges-out in an arc shape toward the external-portion side of the vehicle and in a case in which the longitudinal direction of the antenna portion (longitudinal direction of the antenna unit 100) is formed along the longitudinal direction of the housing 210, it becomes possible, caused by the structure of the present embodiment, to suitably fill-in the portion whose gap between the inner surface housing 210 and the antenna unit 100 tends to become large (portion whose gap between the inner surface of the housing 210 and the antenna portion tends to become large) by the conductive member 50.

[Fifth Embodiment]

Figure 8B:
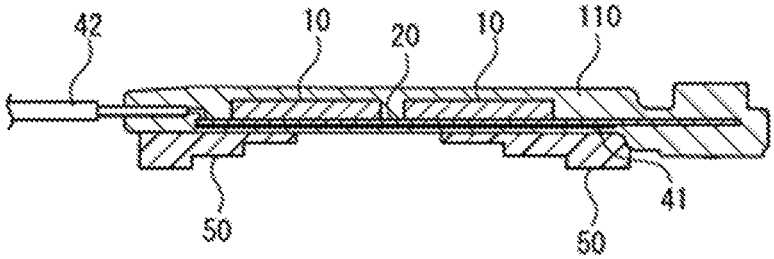
FIG. 8B is a schematic view of an antenna unit relating to a fifth embodiment.

FIG. 8B is a schematic view of an antenna unit 100 relating to a fifth embodiment. The antenna unit 100 relating to this embodiment is different from the abovementioned first embodiment in that the thickness of each conductive member 50 changes in a stepwise fashion, and for other configurations, there are employed similar configurations as those of the antenna unit 100 relating to the first embodiment.

In more detail, for each conductive member 50, the thickness thereof is formed to become larger in a stepwise fashion from the center portion to the end portions in the longitudinal direction of the antenna unit 100.

Also in this embodiment, the center portion in the longitudinal direction of the housing 210 is formed in a curved shape which bulges-out in an arc shape toward the external-portion side of the vehicle and in a case in which the longitudinal direction of the antenna portion (longitudinal direction of the antenna unit 100) is formed along the longitudinal direction of the housing 210, it becomes possible, caused by the conductive member 50, to suitably fill-in the portion whose gap between the inner surface housing 210 and the antenna unit 100 tends to become large (portion whose gap between the inner surface of the housing 210 and the antenna portion tends to become large).

As described above, the respective embodiments are explained with reference to the drawings, but those are illustrative examples of the present invention and it is also possible to employ various constitutions other than the abovementioned examples.

For example, the conductive member 50 is not limited by the straight shape which extends straightforwardly along the longitudinal direction of the antenna unit 100 (in the first embodiment (see FIG. 2)), but it is also allowed to employ a zigzag shape along the thickness direction of the conductive member 50. More specifically, it is allowed for the conductive member 50 to be formed, for example, in a shape which has alternative displacements toward the upper side (toward the coating member 110 side) and toward the lower side (toward the side away from the coating member 110) in the right-left direction of FIG. 2.

In addition, it is possible for the abovementioned respective embodiments to be combined together arbitrarily within a scope without departing from the gist of the present invention.

The present embodiments cover the following technical ideas.

(1) A door handle including: a housing mounted swingably with respect to a door of a vehicle; an antenna portion accommodated in the housing; an electrostatic-capacity sensor including an electrostatic-capacity detecting electrode, which is accommodated in the housing; and a conductive member which is formed between the electrostatic-capacity detecting electrode and the inner surface of the housing in a state of always being insulated with respect to the electrostatic-capacity detecting electrode.

(2) The door handle according to (1), wherein the conductive member is constituted by a flexible material and is formed in a compressed state between the electrostatic-capacity detecting electrode and the inner surface of the housing.

(3) The door handle according to (2), wherein a plurality of ribs are formed on the inner surface of the housing, and at least a portion of the conductive member enters into a space formed between two adjacent ones of the plurality of ribs.

(4) The door handle according to (2) or (3), wherein the conductive member is a conductive sponge.

(5) The door handle according to any one of (1) to (4), wherein the aforesaid door handle is a lever-type handle in which one end portion in the longitudinal direction of the housing is pivotally supported with respect to the door, for the housing, the center portion of the aforesaid housing in the longitudinal direction thereof is formed in a curved shape which bulges-out in an arc shape toward the external-portion side of the vehicle in a state in which the aforesaid door handle is mounted on the door, the longitudinal direction of the antenna portion is formed along the longitudinal direction of the housing, and the conductive member is formed at each of the positions corresponding to the plurality of places separated from each other in the longitudinal direction of the antenna portion.

(6) The door handle according to any one of (1) to (5), wherein when seen toward the surface-perpendicular direction with respect to the electrostatic-capacity detecting electrode, the conductive member includes an overlapping portion which overlaps with the electrostatic-capacity detecting electrode and an extension-portion which does not overlap with the electrostatic-capacity detecting electrode.

(7) An antenna unit including: an antenna; an electrostatic-capacity sensor including an electrostatic-capacity detecting electrode; an insulating coating member which coats the antenna and the electrostatic-capacity detecting electrode; and a conductive member fixed on the outer surface of the coating member.

(8) The antenna unit according to (7), including a substrate on which the antenna and the electrostatic-capacity detecting electrode are installed and concurrently, which is coated by the coating member, wherein on one surface side of the substrate, there are formed the electrostatic-capacity detecting electrode and the conductive member.

(9) The antenna unit according to (7) or (8), wherein the conductive member is formed at each of the positions corresponding to the plurality of places separated from each other in the longitudinal direction of the aforesaid antenna unit.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A door handle comprising:

a housing swingably mounted on a door of a vehicle;

a plurality of ribs formed on an inner surface of the housing;

an antenna member accommodated in the housing;

an electrostatic-capacity sensor including an electrostatic-capacity detecting electrode, the electrostatic-capacity sensor being accommodated in the housing; and a conductive member which is formed between the electrostatic-capacity detecting electrode and the inner surface of the housing, the conductive member being insulated from the electrostatic-capacity detecting electrode, wherein the conductive member is constituted by a flexible material and is compressed between the electrostatic-capacity detecting electrode and the inner surface of the housing, and at least a portion of the conductive member exists in a space between two adjacent ribs of the plurality of ribs.

2. The door handle according to claim 1, wherein the conductive member is a conductive sponge.

3. The door handle according to claim 1, wherein the door handle is a lever-type handle in which one end portion of the housing in a longitudinal direction is pivotally supported by the door, a center portion of the housing in the longitudinal direction is formed in a curved shape so as to be outwardly arched, the antenna member is formed along the housing in the longitudinal direction thereof, and the conductive member is configured by a plurality of the conductive members, each of the plurality of the conductive members is formed at each of a plurality of places separated from each other in the longitudinal direction of the antenna portion.

4. The door handle according to claim 1, wherein the conductive member includes first and second areas, the first area of the conductive member overlaps with the electrostatic-capacity detecting electrode in a plan view, and the second area of the conductive member is laterally shifted from the electrostatic-capacity detecting electrode in the plan view.

5. A door handle comprising:

a housing swingably mounted on a door of a vehicle;

an antenna member accommodated in the housing;

an electrostatic-capacity sensor including an electrostatic-capacity detecting electrode, the electrostatic-capacity sensor being accommodated in the housing; and a conductive member which is formed between the electrostatic-capacity detecting electrode and an inner surface of the housing, the conductive member being insulated from the electrostatic-capacity detecting electrode, wherein the door handle is a lever-type handle in which one end portion of the housing in a longitudinal direction is pivotally supported by the door, a center portion of the housing in the longitudinal direction is formed in a curved shape so as to be outwardly arched, the antenna member is formed along the housing in the longitudinal direction thereof, and the conductive member is configured by a plurality of the conductive members, each of the plurality of the conductive members is formed at each of a plurality of places separated from each other in the longitudinal direction of the antenna member.

6. The door handle according to claim 5, wherein the conductive member is constituted by a flexible material and is compressed between the electrostatic-capacity detecting electrode and the inner surface of the housing.

7. The door handle according to claim 6, wherein a plurality of ribs are formed on the inner surface of the housing, and at least a portion of the conductive member exists in a space between two adjacent ribs of the plurality of ribs.

8. The door handle according to claim 5, wherein the conductive member is a conductive sponge.

9. The door handle according to claim 5, wherein the conductive member includes first and second areas, the first area of the conductive member overlaps with the electrostatic-capacity detecting electrode in a plan view, and the second area of the conductive member is laterally shifted from the electrostatic-capacity detecting electrode in the plan view.

* * * * *